US006109470A

United States Patent [19]

Antal, Sr. et al.

[11] Patent Number: 6,109,470

[45] **Date of Patent: *Aug. 29, 2000**

[54] CONTAINER AND CONDIMENT CUP FOR REFRIGERATED DOUGH OR LIKE PRODUCTS

[75] Inventors: Keith Antal, Sr., Valatie, N.Y.; Glenda Cahill, Florence, S.C.; James Johanson, Chatham, N.Y.; Victor DesRosiers, Kinderhook, N.Y.; James Stevens, Castleton, N.Y.

[73] Assignee: Sonoco Development, Inc., Hartsville, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/865,082

[22] Filed: May 29, 1997

[51] Int. Cl.[7] ..... B65D 1/24

[52] U.S. Cl. ..... 220/505; 220/240; 229/4.5; 206/830; 426/124; 426/128

[58] Field of Search ..... 426/128, 124; 220/505, 504, 503, 231, 281, 240, DIG. 19; 215/262, 270–271; 206/830; 229/405, 505

[56] References Cited

U.S. PATENT DOCUMENTS

| | | | |
|---|---|---|---|
| 2,949,369 | 8/1960 | Zoeller et al. . | |
| 3,015,429 | 1/1962 | Morici . | |
| 3,182,890 | 5/1965 | Elam | 206/830 X |
| 3,385,503 | 5/1968 | Stump . | |
| 3,506,459 | 4/1970 | Parlour . | |
| 3,851,757 | 12/1974 | Turpin . | |
| 3,962,476 | 6/1976 | Turpin . | |
| 4,114,784 | 9/1978 | Hough et al. . | |
| 4,388,336 | 6/1983 | Yong et al. . | |
| 5,181,615 | 1/1993 | Thompson | 220/618 |
| 5,458,252 | 10/1995 | Logel | 215/271 |

*Primary Examiner*—Stephen P. Garbe
*Assistant Examiner*—Tri M. Mai
*Attorney, Agent, or Firm*—Alston & Bird LLP

[57] ABSTRACT

A container for refrigerated dough or other expandable products and a condiment cup therein for containing icing and the like includes the following construction. The container has an elongate cylindrical body with an interior wall of a predetermined diameter and end closures. The condiment cup is of a flexible plastic generally cup-shaped construction having a generally cylindrical side wall closed at one end by a dome-shaped convex end and open at the other end. The cylindrical side wall has an outside diameter only slightly less than the diameter of the container interior wall so as to provide a loose friction fit when the condiment cup is positioned within the container cylindrical body portion. The condiment cup is filled with condiment and positioned within the container at one end of the cylindrical body portion with the open end of the cup facing the end closure at the one end. The container is filled with refrigerated dough or other expandable product, so that, as the product expands within the container, the product will push against the dome-shaped convex end of the condiment cup for flexing the cup end inwardly to cause flexing of the cup side wall outwardly to provide a tighter friction fit with the container interior wall to seal the condiments in the cup from the product in the container.

4 Claims, 1 Drawing Sheet

CONTAINER AND CONDIMENT CUP FOR REFRIGERATED DOUGH OR LIKE PRODUCTS

FIELD OF THE INVENTION

This invention is directed to a container for refrigerated dough or other expandable products and a condiment cup therein for containing icing and the like.

BACKGROUND OF THE INVENTION

In the packaging of some refrigerated dough products in containers including spirally wound composite containers having double seamed metal ends, it is sometimes desirable to include condiments, such as icing and the like, inside the container so that when the consumer opens the container to remove the refrigerated dough for baking, they will also have access to the condiment, such as icing and the like. It has been common practice to package the icing in a pouch, place the icing in a paper sleeve and position the paper sleeve at one end of the refrigerated dough container and to have a loose metal separator between the dough and the icing pouch positioned in the paper sleeve. However, this arrangement produced major problems in that the refrigerated dough in the container often extrudes a "syrup" like substance which can pass by the metal separator, penetrate the paper sleeve containing the icing pouch resulting in disintegration and crushing of the sleeve and ultimately in container failure. The edge of the metal separator often also cuts into the container liner allowing the dough "syrup" to wet the body of the container and subsequently leading to reduced shelf life of the refrigerated dough package.

In order to overcome some of these problems, it has been suggested to utilize a small cup of plastic or the like material to be positioned at one end of the refrigerated dough container with the open end facing the end closure for containing the condiment within the cup. It has also been suggested to provide this plastic cup containing the condiment with a flange at the closed end thereof in an attempt to seal off the remainder of the cup and the open end thereof containing the condiment from the liquid or "syrup" extruded by the dough in the container. This type of arrangement is disclosed in prior U.S. Pat. No. 3,182,890. It is stated in this U.S. patent that as the dough expands and generates pressure due to "leavening" of the dough, the pressure against the flange on the plastic cup increases the effectiveness of the seal to prevent liquid from the dough from passing into the condiment compartment.

While in theory, the plastic cup condiment arrangement of this prior U.S. Pat. No. 3,182,890 may overcome some of the problems with the prior arrangement discussed above, the disclosed structure of this plastic cup with a flange is not practical from a commercial manufacturing standpoint. These plastic cups are either injection molded or blow molded from plastic material and the formation of a flange on the closed end of the cup is not practical from a commercial manufacturing standpoint. Also, it is believed that the pressure and forces generated by "leavening" of the dough in the container would cause the flat surface of the closed end of the plastic condiment cup of prior U.S. Pat. No. 3,182,890 to become concave and, thereby, move or loosen the sealing engagement of the flange of the condiment cup with the inside of the container.

OBJECT AND SUMMARY OF THE INVENTION

Accordingly, it is the object of this invention to provide a plastic condiment cup for containing icing and the like for use in a container for refrigerated dough or other expandable products and which includes a construction which can be economically commercially manufactured and which will provide a desired seal between the condiment cup and the dough or other expandable product in the container.

It has been found by this invention that this object may be accomplished by providing a container and a condiment cup which include the following. The container comprises an elongate cylindrical body having an interior wall of a predetermined diameter, and end closures. The condiment cup comprises a flexible plastic generally cup-shaped member having a generally cylindrical side wall closed at one end by a dome-shaped convex end and open at the other end. The cylindrical side wall has an outside diameter only slightly less than the diameter of the container interior wall so as to provide a loose friction fit when the condiment cup is positioned within the container cylindrical body portion. The condiment cup is adapted to be filled with condiments and positioned within the container at one end of the cylindrical body portion with the open end of the cup facing the end closure at the one end. The container is adapted to be filled with refrigerated dough or other expandable product, so that, as the product expands within the container, the product will push against the dome-shaped convex end of the condiment cup for flexing the cup end inwardly to cause flexing of the cup side wall outwardly to provide a tighter friction fit with the container interior wall to seal the condiments in the cup from the product in the container.

Preferably, the cylindrical side wall of the condiment cup includes a thickened wall portion, at an area thereof where the cylindrical side wall joins the dome-shaped convex end, to define an outside diameter in the thickened wall portion which is slightly greater than the outside diameter of the remaining portion of the cylindrical side wall to enhance the friction fit and seal created when the dome-shaped convex end of the condiment cup is flexed inwardly by the expanding product in the container. The body portion of the container is preferably constructed of spirally-wound composite material and the end closures of the container preferably comprise metal ends seamed to the body portion of the container.

With the above described construction, the condiment cup, preferably with a thickened wall at the juncture of the cylindrical side wall with the dome-shaped convex end, can be easily economically and commercially manufactured by injection molding or blow molding, since this condiment cup construction does not include the complex flange arrangement heretofore suggested. Also, this dome-shaped convex end, as opposed to a flat end of the prior art condiment cup construction, enhances expansion of the side wall of the condiment cup and, preferably the thickened wall portion thereof, rather than causing contraction thereof which may occur when a flat end is transformed into a concave end.

BRIEF DESCRIPTION OF THE DRAWINGS

Some of the objects and advantages of this invention have been set forth above, other objects and advantages will appear in the detailed description of a preferred embodiment of this invention to follow, when taken in conjunction with the accompanying drawings, in which.

DETAILED DESCRIPTION OF PREFERRED EMBODIMENT

Figure 1:
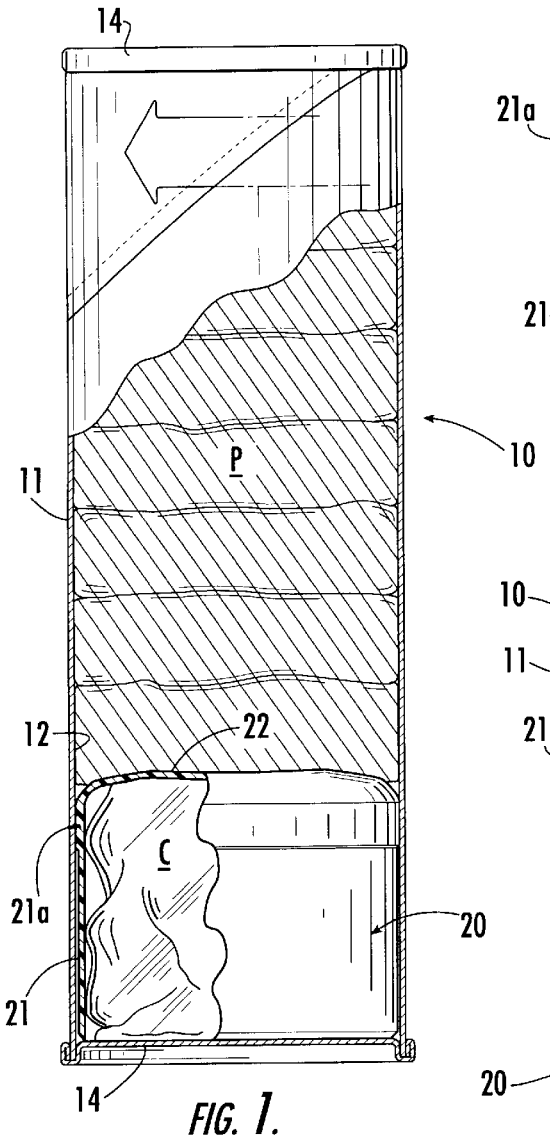
FIG. 1 is an elevational view, partially broken away and in section, of a container having refrigerated dough or other expandable products therein and a condiment cup therein containing icing or the like, which is constructed in accordance with the present invention.

Referring now to the drawings, there is shown, particularly in FIG. 1, a container 10 for refrigerated dough or other expandable products P and a condiment cup 20 positioned within the container 10 for containing icing or other condiments C. The container 10 comprises an elongate generally cylindrical body portion 11 having an interior wall 12 of a predetermined diameter. The container 10 further includes end closures 14. A preferred construction of the body portion 11 of the container 10 when used for refrigerated dough products P is a spirally-wound construction of composite material. These spirally-wound composite containers are well understood by those with ordinary skill in the art and a full explanation hereof is not deemed necessary for an understanding of this invention. The end closures 14 are preferably metal ends seamed to the body portion 11, as shown in FIG. 1 and which is also well known to those with ordinary skill in the art.

The condiment cup 20 comprises a flexible plastic generally cup-shaped member having a generally cylindrical side wall 21 closed at one end by a dome-shaped convex end 22 and open at the other end. The cylindrical side wall 21 has an outside diameter only slightly less than the diameter of the container interior wall 12, as may be clearly seen in the drawing, so as to provide a loose friction fit when the condiment cup 20 is positioned within the container cylindrical body portion 11 of the container 10.

The cylindrical side wall 21 of the condiment cup 20 preferably includes a thickened wall portion 21 a, at an area thereof where the cylindrical side wall 21 joins the dome-shaped convex end 22, to define an outside diameter in the thickened wall portion 21 a which is slightly greater than the outside diameter of the remaining portion of the cylindrical side wall 21.

Figure 2:
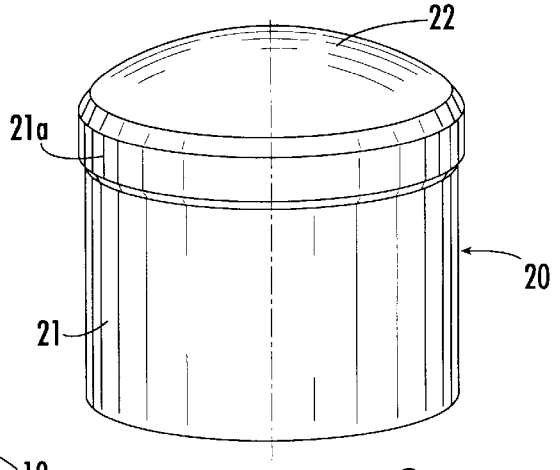
FIG. 2 is a perspective view of the condiment cup for containing icing and the like which is utilized in FIG. 1.
Figure 3:
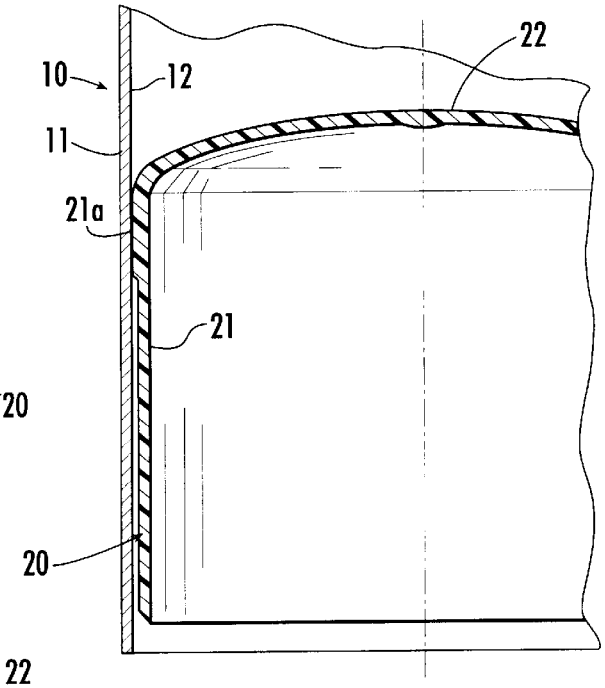
FIG. 3 is an enlarged partial sectional view of the condiment cup in the container and showing the dome-shaped convex end of the condiment cup in its shape prior to the refrigerated dough product pushing against the end thereof for flexing the cup end inwardly.
Figure 4:
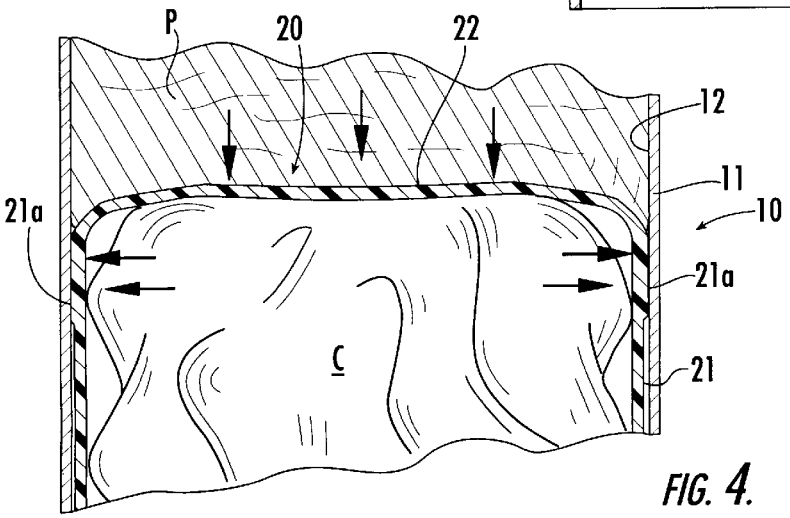
FIG. 4 is a partial sectional view of the condiment cup in the container, somewhat like FIG. 3, but showing the dome-shaped convex end of the condiment cup flexed inwardly by forces of the expandable product to cause flexing of the cup side wall outwardly to provide a tighter friction fit with the container interior wall to seal the condiments in the cup from the expandable product in the container.

The condiment cup filled with condiment C is positioned within the container 10 at one end of the cylindrical body portion 11 with the open end of the cup 20 facing the end closure 14 at the one end. The container is filled with refrigerated dough or other expandable product P and as the product P expands within the container 10, the product P will push against the dome-shaped convex end 22 of the condiment cup 20 (as shown particularly in FIG. 4) for flexing the dome-shaped convex end 22 from its normal position (as shown in FIGS. 2 and 3) inwardly to cause flexing of the cup side wall 21 and 21a outwardly to provide a tight friction fit with container interior wall to seal the condiment C in the cup 20 from the product P in the container 10 (as shown in FIGS. 1 and 4). The thickened wall portion 21 enhances this friction fit and seal created when the dome-shaped convex end 22 of the condiment cup 20 is flexed inwardly by the expanding product P in the container 10.

This plastic condiment cup 20 with its preferable thickened wall portion 21 a may be easily, economically and commercially produced by either injection molding or blow molding and does not include complicated flange or other structures which would impede this commercial manufacturing operation.

In the drawings and the specification, there has been set forth preferred embodiments of the invention and, although specific terms are employed, the terms are used in a generic and descriptive sense only and not for purpose of limitation, the scope of the invention being set forth in the following claims.

What is claimed is:

1. A container for containing an expandable food product and a condiment, said container comprising:

a tubular body formed of a composite material, said tubular body having a pair of opposed ends;

an end closure affixed to each end of said tubular body; and a cup for holding the condiment and separating and protecting the condiment from the food product, said cup having;

a sidewall having an outer dimension which allows the cup to fit within the tubular body, an open end adjacent one of said end closures, and a closed end opposite the open end, said closed end for facing the expandable food product and being movable between an initial position and a final position as the product expands within the container, said closed end having a convex, dome shape when in said initial position and having a flatter shape when in said final position which causes the sidewall to be expanded outwardly to seal against the tubular body and prevent the food product from escaping around the cup.

2. A container as defined in claim 1 wherein a portion of said cup sidewall adjacent the closed end of the cup has an outer dimension greater than the remaining portion of the sidewall to enhance the seal when said closed end is in the final position.

3. A container as defined in claim 1 wherein said tubular body is formed of a spirally wound composite material.

4. A container as defined in claim 1 wherein said cup is formed of molded plastic.

* * * * *